US010195098B2

(12) United States Patent
Roeder

(10) Patent No.: US 10,195,098 B2
(45) Date of Patent: Feb. 5, 2019

(54) DECOMPRESSION CHAIR FOR LOWER BACK

(71) Applicant: Gordon Roeder, Quakertown, PA (US)

(72) Inventor: Gordon Roeder, Quakertown, PA (US)

( * ) Notice: Subject to any disclaimer, the term of this patent is extended or adjusted under 35 U.S.C. 154(b) by 164 days.

(21) Appl. No.: 15/273,002

(22) Filed: Sep. 22, 2016

(65) Prior Publication Data

US 2017/0128310 A1 May 11, 2017

(51) Int. Cl.
*A61H 1/02* (2006.01)

(52) U.S. Cl.
CPC ..... *A61H 1/0229* (2013.01); *A61H 1/0292* (2013.01); *A61H 2201/0119* (2013.01); *A61H 2201/0149* (2013.01); *A61H 2201/0192* (2013.01); *A61H 2201/1619* (2013.01); *A61H 2201/1652* (2013.01); *A61H 2205/081* (2013.01)

(58) Field of Classification Search
CPC .... A61H 1/008; A61H 1/0229; A61H 1/0218; A61H 1/0292; A61H 2201/0138; A61H 2201/0149; A47C 3/20; A47C 7/004; A47C 7/006; A47C 9/002
USPC ..... 602/36, 32–34; 297/273, 465
See application file for complete search history.

(56) References Cited

U.S. PATENT DOCUMENTS 963,890 A * 7/1910 Haas ..... 602/32
2,712,820 A * 7/1955 Robinson ..... A61H 1/0218 602/36
3,167,068 A * 1/1965 Carr ..... A61H 1/0218 602/32
5,088,476 A * 2/1992 Burton ..... A61H 1/0229 606/241
5,462,518 A 10/1995 Hatley et al.
5,626,540 A 5/1997 Hall
5,848,984 A * 12/1998 Bachar ..... A61F 5/01 602/32
6,152,950 A 11/2000 Shealy et al.
6,790,194 B1 * 9/2004 Katane ..... A61H 1/0229 482/142
7,097,628 B1 * 8/2006 Baune ..... A61F 5/3769 297/464
7,217,247 B2 5/2007 Dariush et al.
7,601,132 B2 10/2009 Nichols et al.
8,597,221 B2 12/2013 Lisowski
8,790,371 B2 7/2014 Dyer et al.
9,198,820 B2 12/2015 Philipson
9,205,015 B2 12/2015 Guillen
9,226,865 B2 1/2016 Jackson et al.
2013/0184615 A1 7/2013 Johnson
2014/0142487 A1 5/2014 Arico
2014/0309573 A1 * 10/2014 Tillotson ..... A61F 5/048 602/36

* cited by examiner

*Primary Examiner* — Kari K Rodriquez
(74) *Attorney, Agent, or Firm* — Michael J. Feigin, Esq.; Feigin and Fridman LLC

(57) ABSTRACT

A spinal decompression harness which hangs from two lines on either side, is attached to a stand. A stool or seat is between the two sides of the stand, and the stand can be attached to a neck of the stool. In this manner, the harness is movable between the two sides of the stand, and one can rotate one or more of the harness, seat, or stand while keeping one's torso abutted to the harness. Their arms can also extend over the harness and be used for writing, typing, and other work, while their spine is decompressed in the harness.

8 Claims, 6 Drawing Sheets

DECOMPRESSION CHAIR FOR LOWER BACK

FIELD OF THE DISCLOSED TECHNOLOGY

The disclosed technology relates generally to physical therapy, and more specifically, to decompression of the back.

BACKGROUND OF THE DISCLOSURE

Back pain is often the result of improper posture, such as slouching or even sitting too much. This can result in compression of the spine which causes pressure on nerves and discs. The pain impairs a person's ability to function and can get worse over time, leading not only to physical problems but also mental conditions. Treatments include physical therapy, exercise, physical therapy, steroid injections and even surgery.

Methods in the art to relieve spinal compression include stretching exercises, decompression tables, inversion tables, inversion chairs, and back stretching apparatuses. Such apparatuses include U.S. Patent Publication 2014/0142487 to Arico, disclosing a harness on a torso having straps with as many as 10 points of connection to vertical anchor points; U.S. Pat. No. 5,626,540 to Hall disclosing a support apparatus for a torso of a standing person; and U.S. Pat. No. 7,601,132 to Nichols et al. disclosing a traction assembly with a chair.

Simpler products are needed which allow a person to have self-administration and to go about his/her daily routine while having their back supported and decompressed properly.

SUMMARY OF THE DISCLOSED TECHNOLOGY

A back decompression system of embodiments of the disclosed technology has an adjustable height seat, an adjustable height stand with vertical arms rising above each side of the adjustable height seat, and a harness above the adjustable height seat, hanging from each vertical arm of the vertical arms. The adjustable height stand, in embodiments of the disclosed technology, is attached to a neck beneath the seat. The adjustable height stand is further raised off the ground and supported by the seat (stool base) in some embodiments. In others, the adjustable height stand rests on the ground, and the adjustable height seat rests on the ground between the vertical arms of the adjustable height stand. In such embodiments, the adjustable height seat can straddle (be substantially equal in size on both sides) either side of a base of the adjustable height stand.

A height of the harness is calibrated, in embodiments of the disclosed technology, to be above a top of the seat such that it is at a distance between an underarm of a person sitting on a top of the seat, and the top of the seat itself. The harness has, in some embodiments, a mid-section adapted to be in front of a person, and sides adapted to be at sides of a person.

A decompression harness of embodiments of the disclosed technology can also be described as a stand with cuff attached around a neck of a stool. Two side arms extend vertically above the stool, two flexible lines, one extending from each side of said two side arms, are attached to a harness. The harness is held by the two flexible lines above the stool. An open space is created above the harness between each side arm of the two side arms and each line of the two lines.

The harness can be equi-spaced between the two side arms, and the two flexible lines are of identical length, in embodiments of the disclosed technology. The harness further can have two pads on either side of the harness which two pads form an uppermost extent of the harness, and in embodiments, the lowermost extent of the harness as well. The harness, in embodiments, is defined as a device for abutment of, or which does abut, the torso of a user in which all the parts move together. In embodiments, the harness is the entirety of the object hanging from the two flexible lines. The two flexible lines have a first line and a second line, a first line attached to a first pad of the two pads and a second line attached to a second pad of the two pads. (The "pads" have or do not have actual padding, depending on the embodiment of the disclosed technology.)

The first line and second line are attached substantially at a highest point of the harness, in embodiments of the disclosed technology. The harness, in some embodiments, has a mid-region extending laterally across the entirety of a length of the harness, and the first line and the second line are attached respectively to the first and the second pad above the mid-region of the harness.

In one embodiment, the stand is rotatable 360 degrees about the stool, a top of the stool is rotatable 360 degrees about a neck of the stool, and the harness is rotatable only less than 180 degrees about the stand.

"Substantially" and "substantially shown," for purposes of this specification, are defined as "at least 90%," or as otherwise indicated. "Identical" or "exactly," for purposes of this specification, is defined as "within an acceptable tolerance level known in the art." Any device may "comprise," or "consist of," the devices mentioned there-in, as limited by the claims. Any element described may be one of "exactly" or "substantially," as described.

It should be understood that the use of "and/or" is defined inclusively, such that the term "a and/or b" should be read to include the sets: "a and b," "a or b," "a," or "b."

DETAILED DESCRIPTION OF EMBODIMENTS OF THE DISCLOSED TECHNOLOGY

A spinal decompression harness which hangs from two lines on each side is attached to a stand. A stool or seat is between the two sides of the stand, and the stand can be attached to a neck of the stool. In this manner, the harness is movable between the two sides of the stand, and one can rotate one or more of the harness, seat, or stand, while keeping their torso abutted to the harness. Their arms can also extend over or through the harness and be used for writing, typing, and other work, while their spine is decompressed in the harness.

Embodiments of the disclosed technology will become clearer in view of the following description of the figures.

Figure 1:
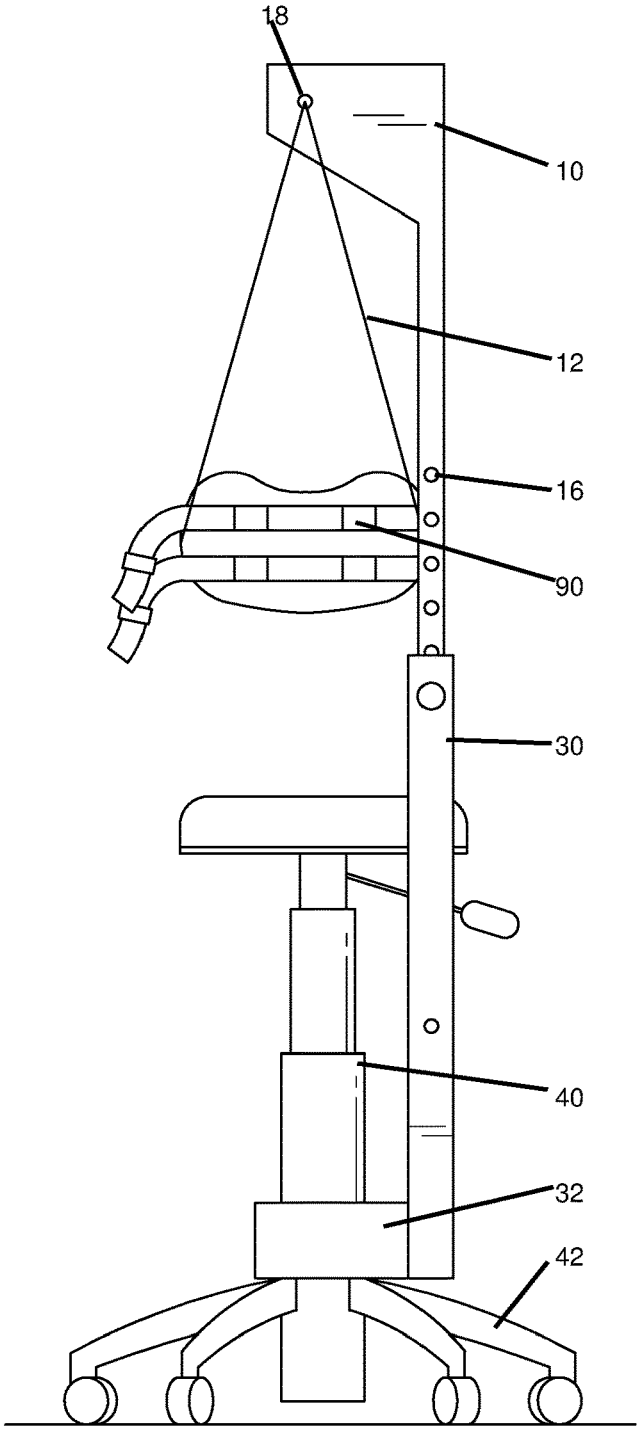
FIG. 1 shows a side elevation view of a back decompression unit attached to a stool, in an embodiment of the disclosed technology.

FIG. 1 shows a side elevation view of a back decompression unit attached to a stool, in an embodiment of the disclosed technology. Here, the back decompression unit has a harness 90 suspending by flexible lines 12 from a top region 10 of a stand. The flexible lines 12 having a fixed and equal length, such as rope, nylon string, or the like, allow the harness to hang, via gravity, from a portal or connection mechanism 18 within the top region 10 of the stand, such that a plane of the harness is disposed substantially parallel to the ground. The top region 10 of the stand can be raised and lowered from a bottom region 30 by way of a series of portals 16 and a peg passing into the portal or other mechanisms known in the art.

Figure 2:
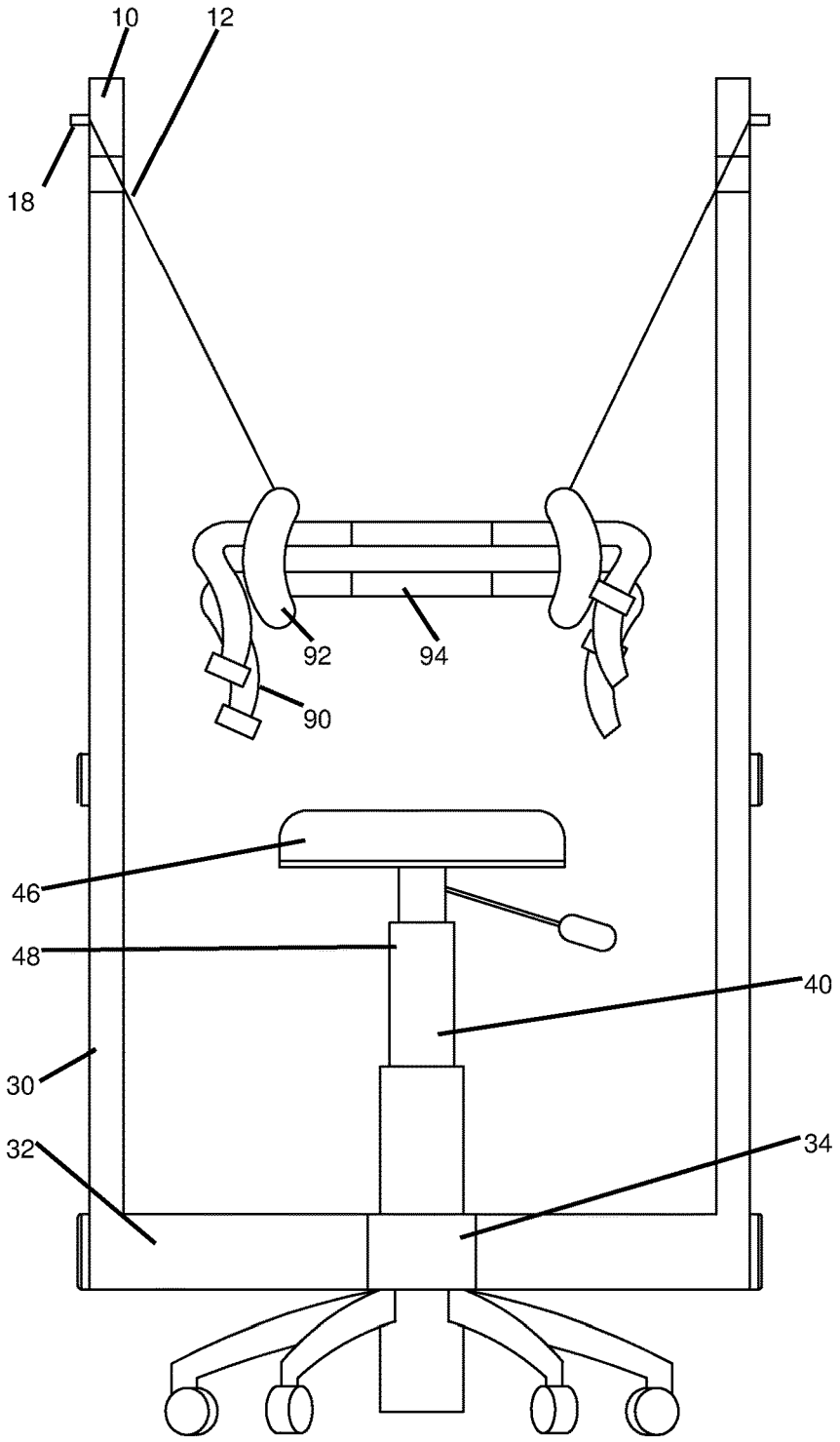
FIG. 2 shows a front elevation view of the back decompression unit attached to a stool of FIG. 1.

The stand has a lateral lower section 32 with a stool neck 48 attachment portal 34 (see FIG. 2). The stool neck attachment portal 34 attaches around a neck 48 of a stool or other chair. The neck 48 of a stool is the elongated region between the legs 42 and seat 46 of the stool 40. The seat of the stool 40 can be raised or lowered and can turn. The harness can also be raised or lowered by raising the top section 10 of the stand. In this manner, the orientation of the harness 90 and person sitting in the stool 40 can be rotated around a plane which is parallel to the ground in 360 degrees. For purposes of this disclosure, the ground is a support surface on which the stool 40 and/or stand 30 rests.

FIG. 2 shows a front elevation view of the back decompression unit attached to a stool of FIG. 1. Here one can see that there is a cuff 34 which forms the stool neck attachment portal. Thus, the stand (10/30/32), in this embodiment, is supported by the neck 48 of the stool 40 and is situated between the wheels and seat of the stool. The arms on the side have a lower portion 30 and upper portion 10 which rise above the height of the stool. As such, the line 12 allows the harness 90 to hang down from the stand and remain above the stool 40. In this manner, one can move/roll the stool 40, along with the stand to a desired location and remain in the harness. Thus, for example, one can place the entire apparatus in an office and use the device while typing at a computer by rolling the device in front of the computer and going about one's daily activities while in the harness 90. The harness 90 keeps the back stretched, in embodiments of the disclosed technology, by situating the harness 90 at a height above the stool, such that the vertebrae are stretched apart and the back is held straight.

The harness 90, in embodiments of the disclosed technology, has a straight mid-portion 94 with padding 92. Side-arms at number 90 in FIG. 2 wrap around the sides of a person's body, while the front of his/her body abuts elements 92 and/or 94 in use. A person's arms are free to be used on either side of the lines 12, between the lines 12 and the top portion 10 of the stand.

Figure 3:
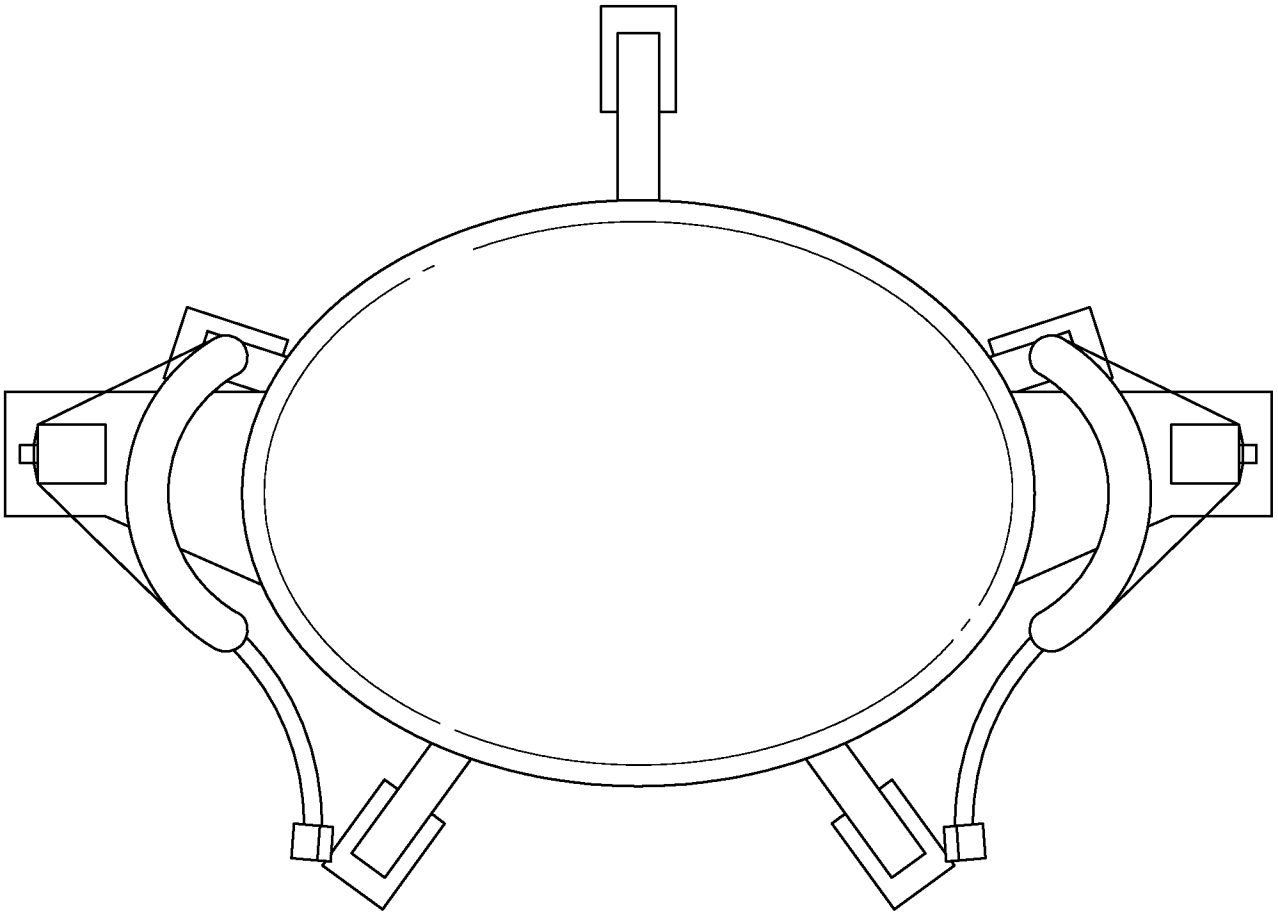
FIG. 3 show a top plan view of the back decompression unit attached to a stool of FIG. 1.

FIG. 3 show a top plan view of the back decompression unit attached to a stool of FIG. 1. Here, one can see the stool beneath, and sidearms extending above, and wider than the stool. As seen in FIGS. 2 and 3, when in a resting position without human intervention, the harness is disposed directly above and spaced apart from the seat of the stool 40, and is centered with respect to the seat of stool 40.

Figure 4:
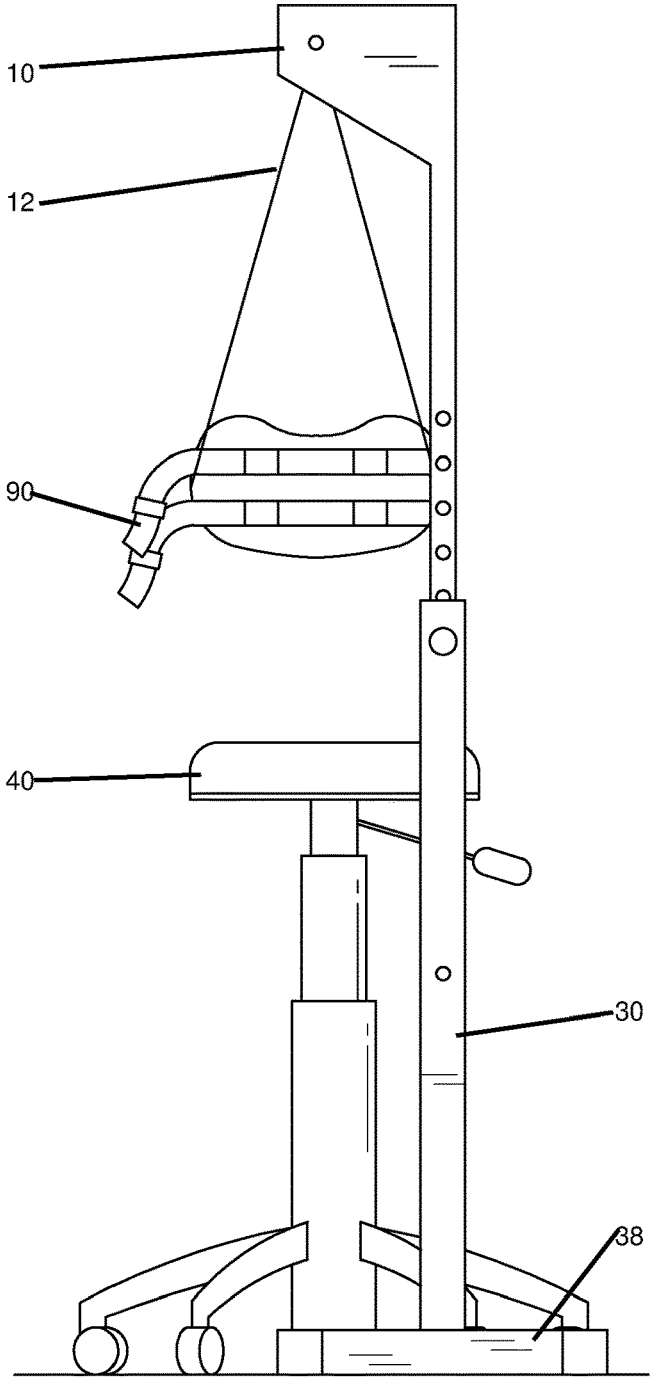
FIG. 4 shows a side elevation view of a back decompression unit with separate stool, in an embodiment of the disclosed technology.

FIG. 4 shows a side elevation view of a back decompression unit with separate stool, in an embodiment of the disclosed technology. In this embodiment, the stand is free-standing on a base 38 which supports the lower portion 30 and upper portion 10. Otherwise, the device functions just like the device of FIGS. 1-3.

Figure 5:
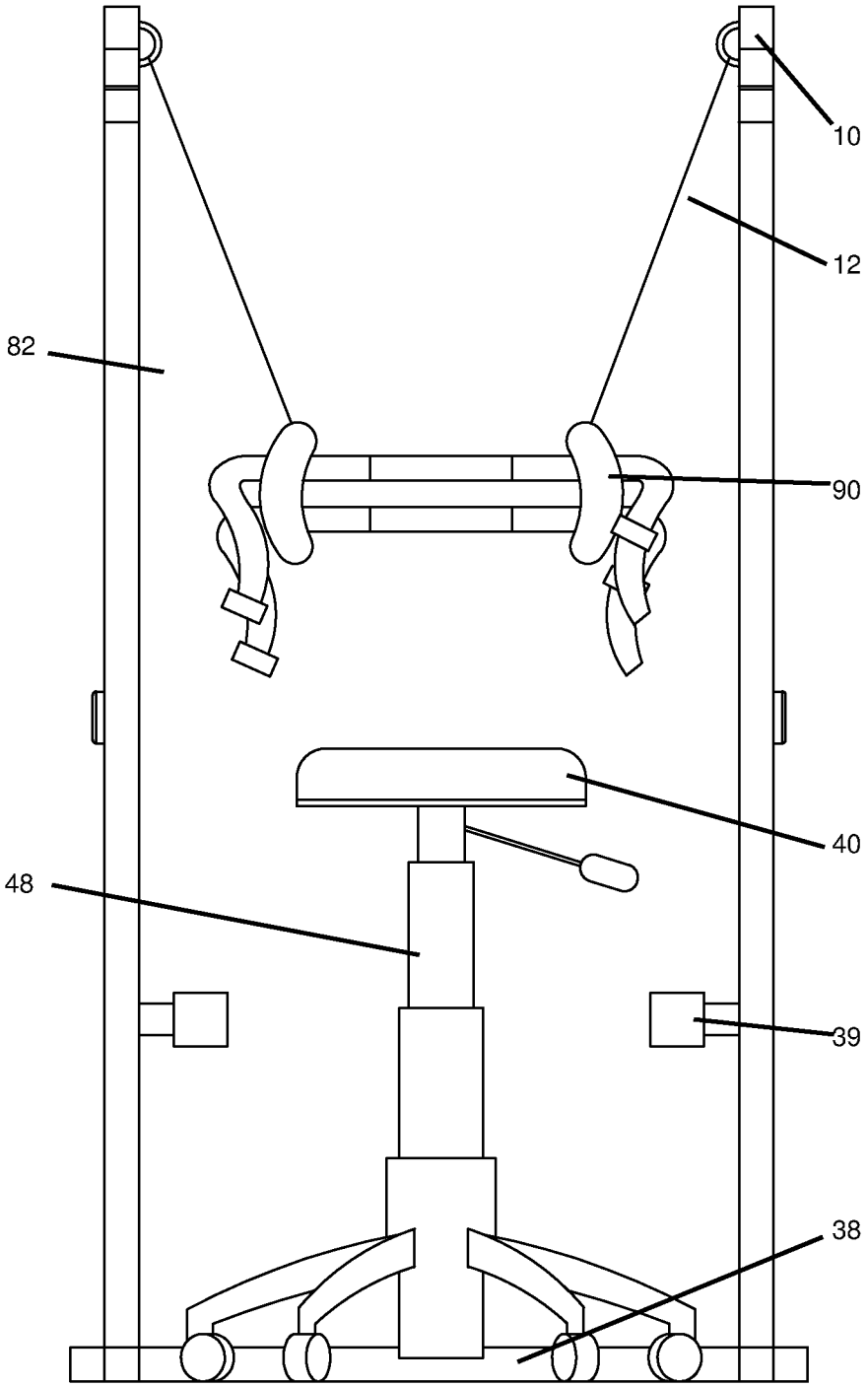
FIG. 5 shows a front elevation view of the back decompression unit with separate stool of FIG. 4.

FIG. 5 shows a front elevation view of the back decompression unit with separate stool of FIG. 4. The stool 40 is freely movable above the base 38 of the stand. Handles 39 can be used to attach the stool further. The stool can be straddled over the base 40 and the base 40 can engage the bottom-most region of the stool. Note that there are many open areas which allow for free range of movement. For example, between upper sides 10 of the stand, each flexible line 12, and the harness 90 one can enclose a triangle 89 by extending an imaginary line from the harness laterally across to the stand. This area is free for placement of one's arms, allowing one to use arms and hands while in the harness. One can further rotate the harness 30, 45, 60, 90, or 180 degrees. Depending on the configuration (e.g., length and tautness of the lines) they can be maximum values of rotation. The stool, and specifically the top/seat 46 of the stool 40, can rotate in 360 degrees in embodiments. Further, the stand can rotate about the stool by way of its cuff 36, so one can actually turn one's body and/or one's stand around in a circle. Their back stays stretched in the harness, and they can move and work at the same time.

Figure 6:
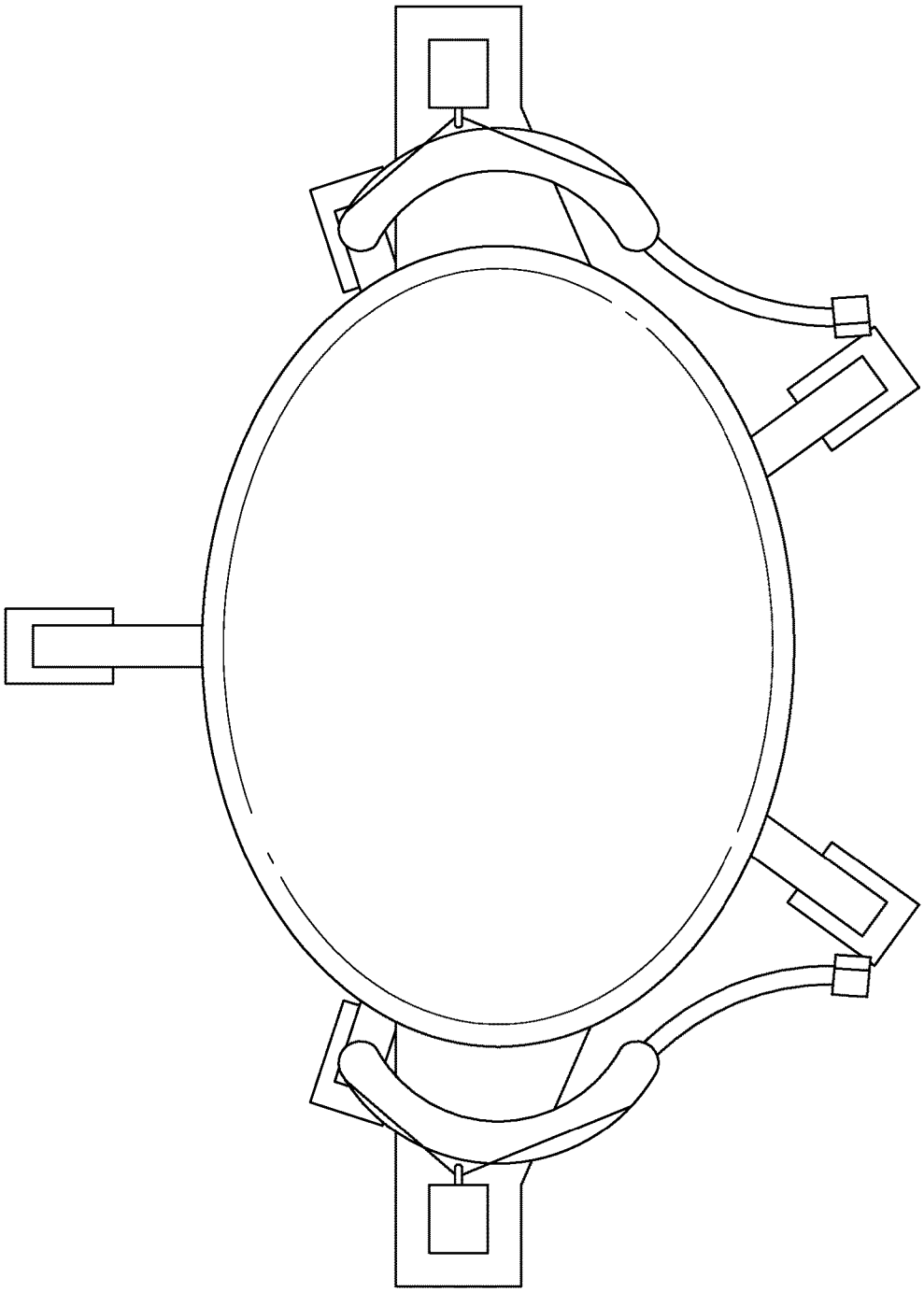
FIG. 6 shows a top plan view of the back decompression unit with separate stool of FIG. 1.

FIG. 6 shows a top plan view of the back decompression unit with separate stool of FIG. 1.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods, systems, and devices described hereinabove are also contemplated and within the scope of the disclosed technology.

The invention claimed is:

1. A back decompression system, comprising:

an adjustable height seat of a stool or chair;

an adjustable height stand including vertical arms disposed at two opposing sides of said adjustable height seat and rising above each side of said stool or chair, wherein a distance between said vertical arms is greater than a greatest width of said adjustable height seat; and a harness hanging via gravity directly over said adjustable height seat above an entire height of said stool or chair and centered, in a resting condition without human intervention, directly above and spaced apart from said adjustable height seat, while hanging by flexible lines from each vertical arm of said vertical arms at an acute angle to each said flexible line of said flexible lines;

wherein said adjustable height seat includes a neck disposed beneath said seat at a center thereof, and wherein said adjustable height stand is attached to said neck of said seat; and wherein said adjustable height stand is raised off the ground and supported by said adjustable height seat.

2. The back decompression system of claim 1, wherein a height of said harness is calibrated to be above a top of said seat, and is adapted, when a person is sitting on said seat, to be between an underarm of the person, and said top of said seat.

3. The back decompression system of claim 2, wherein said harness comprises a midsection adapted to be in front of a person, and sides adapted to be at sides of the person.

4. A decompression harness comprising:

a stand with a cuff attached around a neck of a stool;

two side arms extending vertically above said stool at opposing sides thereof, such that a distance between said two side arms is greater than a greatest width of said stool;

two fixed length flexible lines, one extending from each side of said two side arms, attached to a harness;

said harness held by said two fixed length flexible lines and centered above an entire height of said stool when in a resting position, and calibrated to remain parallel to said stool and at an acute angle to said flexible lines when vertebrae are stretched between said stool and said harness;

an open space above said harness between each side arm of said two side arms and each line of said two lines;

wherein said harness further comprises two pads on either side of said harness, which together form an uppermost extent of said harness; and wherein said two flexible lines comprise a first line and a second line, the first line attached to a first pad of said two pads, and the second line attached to a second pad of said two pads, said first line and said second line attached at a highest point of said harness.

5. The decompression harness of claim 4, wherein said harness is equispaced between said two side arms, and said two flexible lines are of identical length.

6. The decompression harness of claim 4, wherein said harness comprises a midregion extending laterally across an entirety of a length of said harness, and said first line and said second line are attached, respectively, to said first and said second pad above said midregion of said harness.

7. A decompression harness comprising:

a stand with a cuff attached around a neck of a stool;

two side arms extending vertically above said stool at opposing sides thereof, such that a distance between said two side arms is greater than a greatest width of said stool;

two fixed length flexible lines, one extending from each side of said two side arms, attached to a harness;

said harness held by said two fixed length flexible lines and centered above an entire height of said stool when in a resting position, and calibrated to remain parallel to said stool and at an acute angle to said flexible lines when vertebrae are stretched between said stool and said harness;

an open space above said harness between each side arm of said two side arms and each line of said two lines;

wherein said stand and said two side arms are rotatable 360 degrees around said neck of said stool, and said harness is rotatable only less than 180 degrees around said stand.

8. The decompression harness of claim 7, wherein said stand is rotatably 360 degrees around said neck of said stool when a person is seated on said seat of said stool.

* * * * *